US011097559B2

(12) United States Patent
Ito

(10) Patent No.: US 11,097,559 B2
(45) Date of Patent: Aug. 24, 2021

(54) IMAGE FORMING APPARATUS

(71) Applicant: KYOCERA Document Solutions Inc., Osaka (JP)

(72) Inventor: Shigeharu Ito, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/995,649

(22) Filed: Aug. 17, 2020

(65) Prior Publication Data

US 2021/0053372 A1 Feb. 25, 2021

(30) Foreign Application Priority Data

Aug. 20, 2019 (JP) ..... JP2019-150606

(51) Int. Cl.

| | |
|---|---|
| ***B41J 2/01*** | (2006.01) |
| ***B41J 11/42*** | (2006.01) |
| ***B65H 23/188*** | (2006.01) |
| ***B41J 15/04*** | (2006.01) |

(52) U.S. Cl.

CPC ..... *B41J 11/42* (2013.01); *B41J 2/01* (2013.01); *B41J 15/048* (2013.01); *B65H 23/188* (2013.01)

(58) Field of Classification Search

CPC ..... B65H 23/188; B65H 23/18; B41J 11/42; B41J 2/01; B41J 15/048; B41J 3/543; B41J 11/007; B41J 11/006; B41J 11/0095; B41J 29/393; B41J 29/46

See application file for complete search history.

(56) References Cited

U.S. PATENT DOCUMENTS

2021/0016583 A1* 1/2021 Kitayama ..... B41J 13/03

FOREIGN PATENT DOCUMENTS

JP 2001-26154 A 1/2001

* cited by examiner

*Primary Examiner* — Huan H Tran
(74) *Attorney, Agent, or Firm* — Stein IP, LLC

(57) ABSTRACT

An image forming apparatus includes a conveyor belt for conveying a sheet, a plurality of ink heads for fulfilling printing on the sheet, a sensor whose detection position is a position within a belt zone, a controller for halting the printing upon occurrence of jam, and a notification part for executing a notification process that urges cleaning of the conveyor belt. Upon occurrence of jam, the controller, based on an output signal of the sensor, decides for each one of the plurality of ink heads whether or not an ink head is a sheet-nonarrival head where an in-zone sheet has not yet arrived at a gap between the ink head and the conveyor belt, and given that there is no such sheet-nonarrival head, the controller keeps the notification part from executing the notification process.

7 Claims, 11 Drawing Sheets

IMAGE FORMING APPARATUS

INCORPORATION BY REFERENCE

This application is based upon and claims the benefit of priority from the corresponding Japanese Patent Application No. 2019-150606 filed on Aug. 20, 2019, the entire contents of which are incorporated herein by reference.

BACKGROUND

The present disclosure relates to an image forming apparatus which fulfills printing by jetting ink onto a sheet of paper being conveyed by a conveyor belt.

Conventionally, there have been known inkjet-type image forming apparatuses. An inkjet-type image forming apparatus is equipped with a head unit including four ink heads corresponding to cyan, magenta, yellow and black, respectively. The head unit jets out ink from the individual ink heads toward a sheet to print an image on the sheet.

The conventional inkjet-type image forming apparatus, for example, is equipped with a conveyor belt that conveys a paper sheet. Above the conveyor belt, the head unit is placed with a distance therebetween. The head unit jets out ink toward a sheet being conveyed by the conveyor belt.

SUMMARY

The image forming apparatus of the present disclosure includes a conveyor belt, a plurality of ink heads, a sensor, a controller, and a notification part. The conveyor belt conveys a sheet in a belt zone. The plurality of ink heads are placed opposite the conveyor belt with a distance thereto and arrayed with intervals provided to one another in a conveyance direction of the sheet, and jet out ink toward the conveyor belt being under conveyance of the sheet to fulfill printing on the sheet. The sensor has a detection position being a position within the belt zone and outputs a signal corresponding to presence or absence of the sheet at the detection position. The controller, upon occurrence of jam with the sheet, halts the printing. The notification part executes a notification process that urges cleaning of the conveyor belt. In a case where the jam has occurred with an in-zone sheet that is the sheet having entered the belt zone, the controller, based on an output signal of the sensor, decides for each one of the plurality of ink heads whether or not an ink head is a sheet-nonarrival head where a conveyance-direction front end of the in-zone sheet has not yet arrived at a gap between the ink head and the conveyor belt, and given that the sheet-nonarrival head is absent, the controller keeps the notification part from executing the notification process.

DETAILED DESCRIPTION

<Configuration of Image Forming Apparatus>

Figure 1:
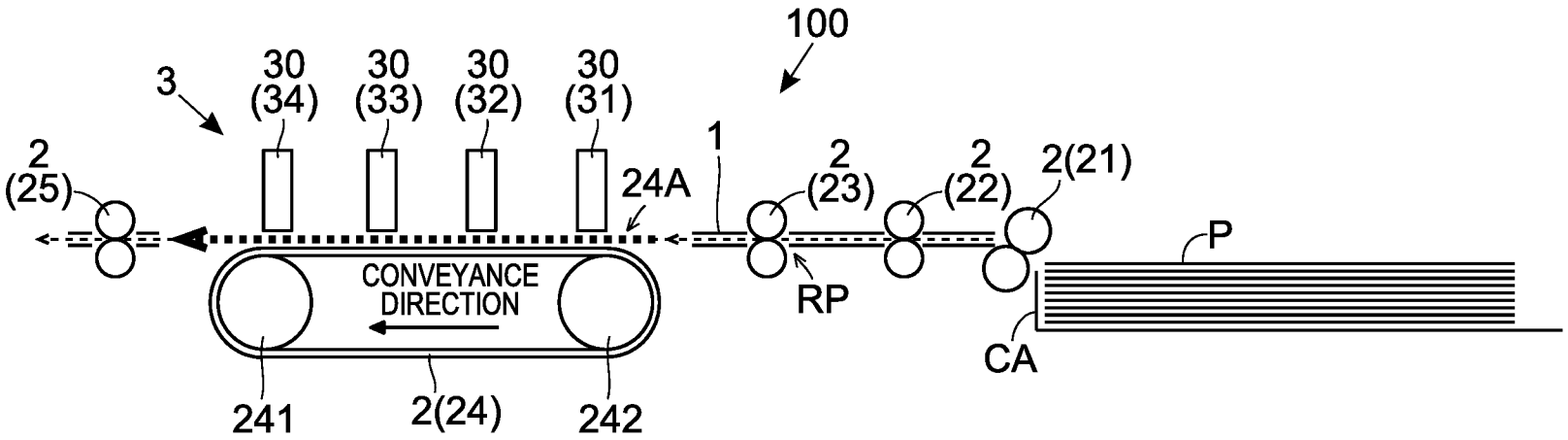
FIG. 1 is a schematic view showing a configuration of an image forming apparatus according to a present embodiment.

As shown in FIG. 1, an image forming apparatus 100 of a present embodiment includes a sheet conveyance path 1. The sheet conveyance path 1 leads from a sheet cassette CA via a registration position RP to a discharge tray (not shown). The image forming apparatus 100 conveys a sheet P of paper along the sheet conveyance path 1. Then, the image forming apparatus 100 prints out an image on the sheet P that is under conveyance.

In FIG. 1, a conveyance path of the sheet P, which is conveyed along the sheet conveyance path 1, is indicated by an arrow of broken line. A direction indicated by the arrow of broken line is a conveyance direction of the sheet P. Hereinafter, a conveyance-direction downstream-side end of the sheet P will be referred to as front end, and its conveyance-direction upstream-side end as rear end.

The image forming apparatus 100 includes a conveyance part 2. The conveyance part 2 conveys the sheet P along the sheet conveyance path 1.

The conveyance part 2 includes a sheet feed roller pair 21 and a feed-side conveyance roller pair 22. The sheet feed roller pair 21 pulls out a sheet P from the sheet cassette CA to feed it onto the sheet conveyance path 1. The feed-side conveyance roller pair 22 conveys the sheet P fed onto the sheet conveyance path 1 toward the registration position RP. The number of feed-side conveyance roller pairs 22 to be set is not particularly limited.

The conveyance part 2 includes a registration roller pair 23. The registration roller pair 23 is set at the registration position RP. The registration roller pair 23 conveys the sheet P toward a later-described conveyor belt 24.

In addition, the registration roller pair 23 is out of rotation at a time point when the sheet P has arrived at the registration position RP. As a result, the conveyance of the sheet P is once halted. In this situation, any skew of the sheet P is corrected. The registration roller pair 23 keeps the sheet P stopped from conveyance until a predetermined skew correction time elapses, thereafter starting the conveyance of the sheet P.

The conveyance part 2 includes a conveyor belt 24. The conveyor belt 24 conveys the sheet P in a belt zone 24A. The sheet P fed up from the registration roller pair 23 enters the belt zone 24A, being conveyed by the conveyor belt 24. In FIG. 1, a conveyance path for the sheet P conveyed by the conveyor belt 24 is depicted by an arrow of bold broken line.

The conveyor belt 24 is an endless belt. The conveyor belt 24 is stretched over a driving roller 241 and a driven roller 242. Rotation of the driving roller 241 causes the conveyor belt 24 to turn around.

The sheet P fed up from the registration roller pair 23 leads onto the conveyor belt 24. When the sheet P arrives onto the conveyor belt 24, the conveyor belt 24 is turning around. As a result, the sheet P on the conveyor belt 24 is conveyed. Although not shown, the conveyor belt 24 is provided with suction holes extending through the conveyor belt 24 in its thicknesswise direction. Further, a suction unit is provided inside the conveyor belt 24. The suction unit generates a negative pressure to suck up the sheet P on the conveyor belt 24.

The conveyance part 2 includes a discharge-side conveyance roller pair 25. The discharge-side conveyance roller pair 25 conveys the sheet P, which is fed up from the conveyor belt 24, toward the discharge tray. The number of discharge-side conveyance roller pairs 25 to be set is not particularly limited.

The image forming apparatus 100 also includes a head unit 3. The head unit 3 is placed above the conveyor belt 24 with a specified distance provided from an outer circumferential surface of the conveyor belt 24. While the conveyor belt 24 is conveying the sheet P (while the sheet P is present in the belt zone 24A), the head unit 3 jets out ink toward the conveyor belt 24. The ink jetted out from the head unit 3 lands on the sheet P set on the conveyor belt 24. As a result, an image is printed on the sheet P.

The head unit 3 includes four ink heads 30 corresponding to cyan, magenta, yellow and black, respectively. Contained in the four ink heads 30 are inks of their corresponding colors, respectively. Each of the four ink heads 30 has a plurality of nozzles 301 (see FIG. 2). In other words, each of the four ink heads 30 has a nozzle plane in which a plurality of nozzles 301 are provided. Each nozzle 301 of the four ink heads 30 is provided with a piezoelectric element (not shown). The four ink heads 30 jet out inks of their corresponding colors, respectively, from the nozzles 301.

Each nozzle plane of the four ink heads 30 is oriented downward. The four ink heads 30 are placed such that their nozzle planes face the outer circumferential surface of the conveyor belt 24 each with a specified distance therebetween. Also, the four ink heads 30 are arrayed in the conveyance direction with intervals provided between one another.

Figure 2:
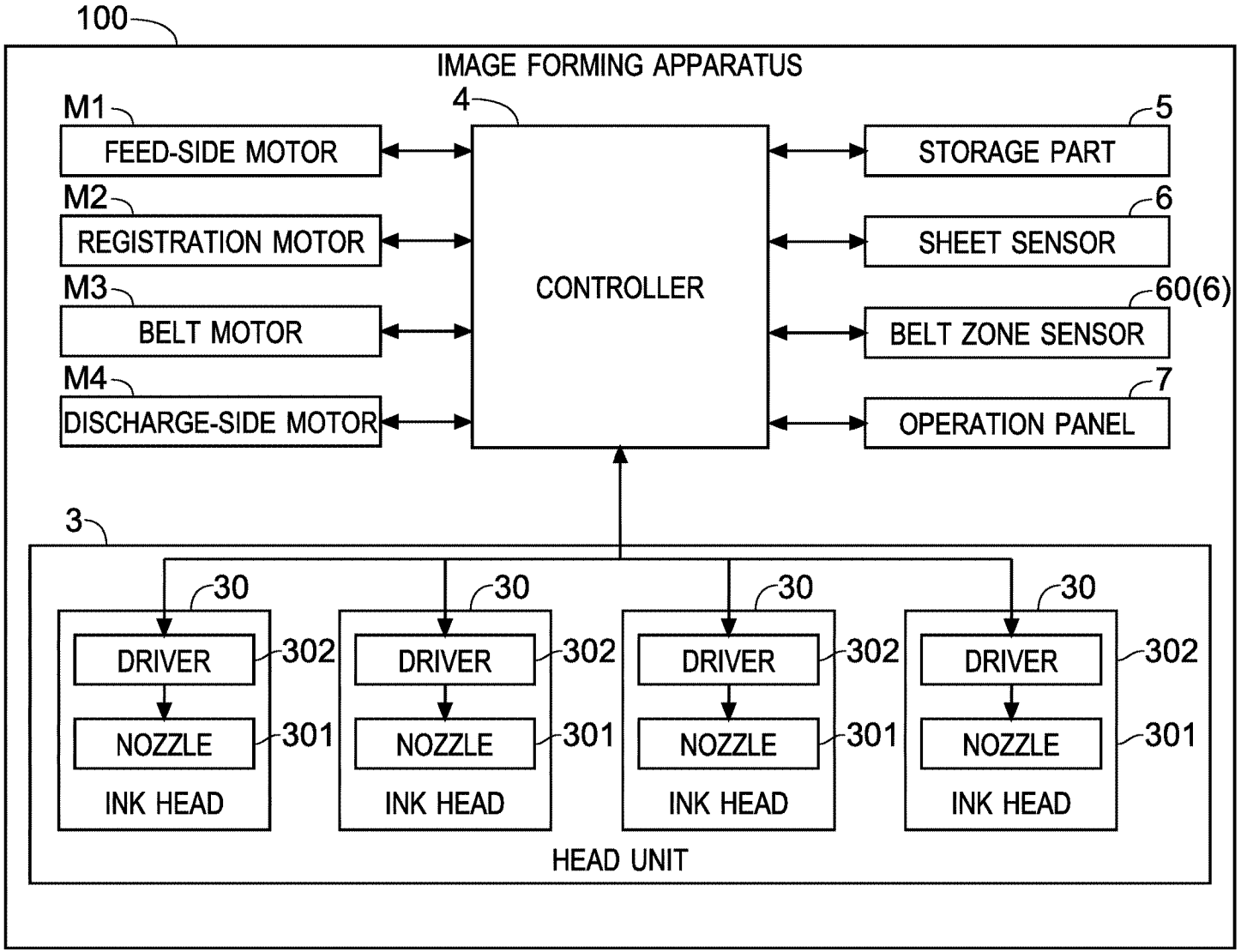
FIG. 2 is a block diagram showing a configuration of the image forming apparatus according to the embodiment.

As shown in FIG. 2, the image forming apparatus 100 is also equipped with a controller 4 and a storage part 5. The controller 4 includes a CPU. The storage part 5 includes ROM, RAM and HDD or other storage devices. The controller 4 operates based on control programs and control data to control individual parts of the image forming apparatus 100. The storage part 5 stores therein control programs and control data.

The controller 4 is connected to conveyance motors serving to rotate rollers in the conveyance part 2. Among the conveyance motors are a feed-side motor M1, a registration motor M2, a belt motor M3, and a discharge-side motor M4.

The feed-side motor M1 is coupled to the sheet feed roller pair 21 and the feed-side conveyance roller pair 22. The controller 4 controls the feed-side motor M1 to properly rotate the sheet feed roller pair 21 and the feed-side conveyance roller pair 22. The sheet feed roller pair 21 receives driving force from the feed-side motor M1 via an unshown sheet feed clutch. The controller 4 controls the sheet feed clutch to switch over between coupling and decoupling of the sheet feed roller pair 21 and the feed-side motor M1.

The registration motor M2 is coupled to the registration roller pair 23. The controller 4 controls the registration motor M2 to properly rotate the registration roller pair 23. The registration roller pair 23 receives driving force from the registration motor M2 via an unshown registration clutch. The controller 4 controls the registration clutch to switch over between coupling and decoupling of the registration roller pair 23 and the registration motor M2.

The belt motor M3 is coupled to the driving roller 241 of the conveyor belt 24. The controller 4 controls the belt motor M3 to properly rotate the driving roller 241. That is, the controller 4 makes the conveyor belt 24 properly turn around.

The discharge-side motor M4 is coupled to the discharge-side conveyance roller pair 25. The controller 4 controls the discharge-side motor M4 to properly rotate the discharge-side conveyance roller pair 25.

The controller 4 is connected to drivers 302 of the head unit 3. The drivers 302 are provided in the ink heads 30, respectively. The controller 4 controls the drivers 302 of the individual ink heads 30 (controls printing operations of the individual ink heads 30).

More specifically, with regard to each ink head 30, the controller 4 generates control signals indicative of nozzles 301 that are assigned to jet out ink (here referred to as jet-out nozzles 301). Then, the controller 4 transmits control signals to drivers 302 of the individual ink heads 30. The drivers 302 of the ink heads 30 execute an inkjet process based on the control signals. The controller 4 controls conveyance of the sheet P in such fashion that each time one-stroke inkjet process is executed, the sheet P is advanced by a one-line (one-dot) width.

The drivers 302 of the ink heads 30 execute, as the inkjet process, a process of applying drive voltages to piezoelectric elements provided in the jet-out nozzles 301 indicated by the control signals, respectively. As a result of this, nozzles 301 corresponding to the piezoelectric elements to which the drive voltages have been applied are driven (ink is jetted out from the relevant nozzles 301).

Further, the image forming apparatus 100 includes a plurality of sheet sensors 6. As an example, optical sensors are used as the sheet sensors 6. Detection positions of the plural sheet sensors 6 are set on the conveyance path of the sheet P. The plural sheet sensors 6 output signals of levels corresponding to presence or absence of the sheet P at their corresponding detection positions, respectively.

The plural sheet sensors 6 are connected to the controller 4. The controller 4 monitors levels of individual output signals of the plural sheet sensors 6 during conveyance of the sheet P (during printing). Based on the levels of the individual output signals of the plural sheet sensors 6, the controller 4 detects conveyance statuses of the sheet P on the sheet conveyance path 1 (front-end arrival and rear-end passage of the sheet P at the individual detection positions of the plural sheet sensors 6). The controller 4, based on the detected conveyance statuses of the sheet P, decides whether or not jam (paper jamming) with the sheet P has occurred on the sheet conveyance path 1. When deciding that jam has occurred, the controller 4 halts a print job. That is, the controller 4 halts the conveyance of the sheet P by the conveyance part 2.

For example, the controller 4 starts time count after detecting a front-end arrival of the sheet P at a detection position of one sheet sensor 6 (here referred to as first sensor 6) out of the plural sheet sensors 6. Then, when a specified time has elapsed since the detection of the front-end arrival of the sheet P at the detection position of the first sensor 6, the controller 4 detects whether or not the front end of the sheet P has arrived at the detection position of another sheet sensor 6 (here referred to as second sensor) located on the conveyance-direction downstream side of the first sensor 6. As a result, when the front-end arrival of the sheet P has not been detected, the controller 4 decides that jam has occurred. The specified time in this case equals a total time resulting from adding a margin time to a time duration required for the sheet P's advance between the detection position of the first sensor 6 and the detection position of the second sensor 6. The specified time is previously set based on both a conveyance distance of the sheet P from the detection position of the first sensor 6 to the detection position of the second sensor 6 and a conveyance speed of the sheet P.

After detection of the front-end arrival of the sheet P at a detection position of one sheet sensor 6 out of the plural sheet sensors 6, given that a rear-end passage of the sheet P has not been detected at the same detection position even with a specified time elapsed, the controller 4 decides that jam has occurred. The specified time in this case equals a total time resulting from adding a margin time to a time duration required from the front-end arrival of the sheet P at a detection position of one sheet sensor 6 until the rear-end passage of the sheet P through the same detection position. The specified time is previously set based on both a conveyance-direction size of the sheet P and a conveyance speed of the sheet P.

In this connection, among the plural sheet sensors 6 is a sensor whose detection position is a position within the belt zone 24A. Hereinafter, a sheet sensor 6 whose detection position is a position within the belt zone 24A will be referred to as belt zone sensor, with reference sign 60 added thereto. The belt zone sensor 60 corresponds to a 'sensor.' The belt zone sensor 60 will be described in detail later.

The image forming apparatus 100 further includes an operation panel 7. The operation panel 7 accepts settings and instructions related to printing from a user. For example, the operation panel 7 includes a touch screen. The touch screen displays an acceptance screen for accepting settings and instructions related to printing.

The operation panel 7 is connected to the controller 4. The controller 4 controls display operations of the operation panel 7. The controller 4 also detects operations made on the operation panel 7. For example, the controller 4 instructs the operation panel 7 to display a massage indicating a status of the image forming apparatus 100.

<Jam Detection with Paper Sheet Having Entered Belt Zone>

Figure 3:
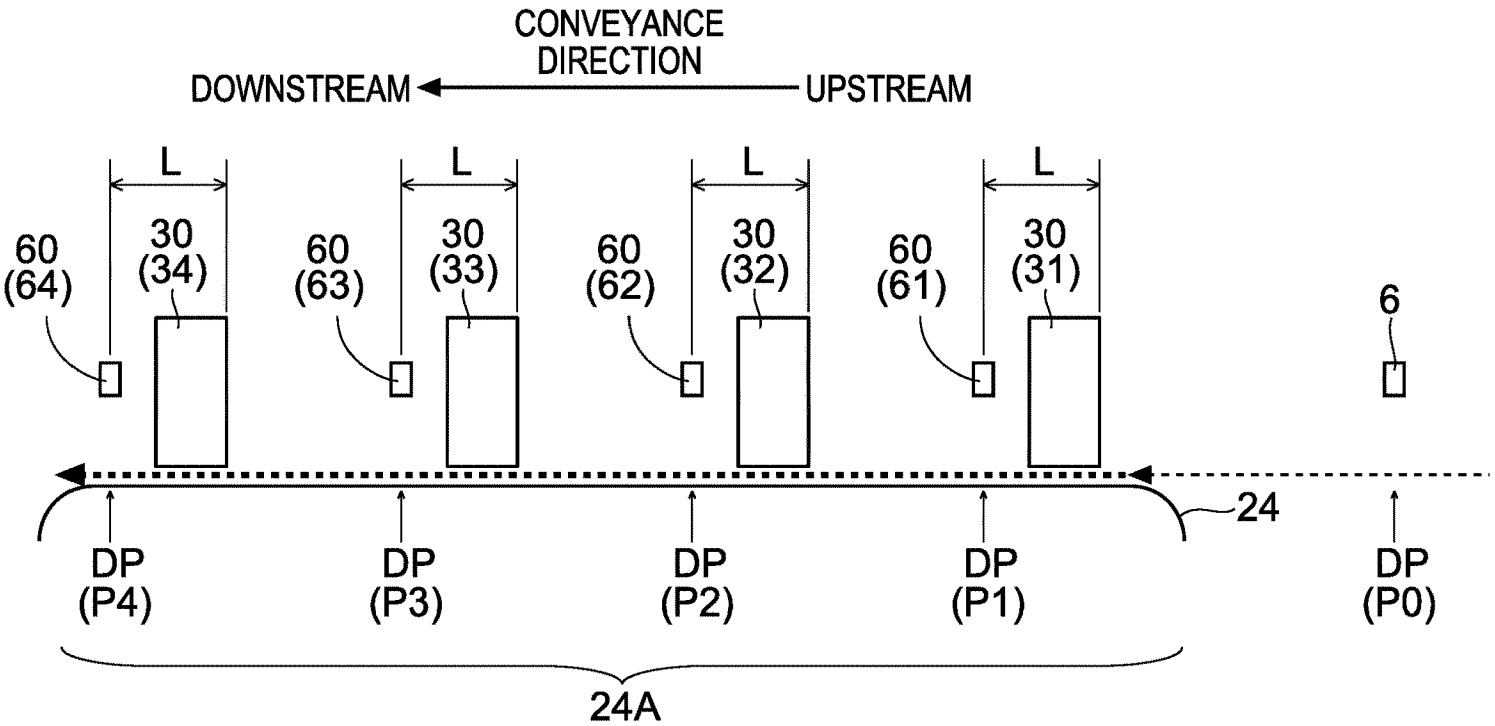
FIG. 3 is a view showing setting positions of sheet sensors (belt zone sensors) to be set in the image forming apparatus according to the embodiment.

As shown in FIG. 3, the setting number of the belt zone sensors 60 is the same (four) as that of the ink heads 30. The belt zone sensors 60 are assigned to the four ink heads 30, respectively, in one-to-one correspondence.

On the conveyance-direction downstream side of the ink head 30 that is located on the most upstream side in the conveyance direction, the four belt zone sensors 60 are arrayed with intervals to one another along the conveyance direction. The four belt zone sensors 60 are set at positions on the conveyance-direction downstream side of setting positions of their corresponding ink heads 30, respectively. More specifically, the four belt zone sensors 60 are set such that their detection positions come to detection positions DP, respectively, each of which is distant by a specified length L from a conveyance-direction upstream-side end position of a corresponding ink head 30 toward the conveyance-direction downstream side.

Hereinafter, the four ink heads 30 may be referred to with reference signs 31, 32, 33 and 34, respectively, added thereto in an order from upstream toward downstream side in the conveyance direction. Also, a belt zone sensor 60 corresponding to the ink head 31 may be referred to with reference sign 61 added thereto, a belt zone sensor 60 corresponding to the ink head 32 may be referred to with reference sign 62 added thereto, a belt zone sensor 60 corresponding to the ink head 33 may be referred to with reference sign 63 added thereto, and a belt zone sensor 60 corresponding to the ink head 34 may be referred to with reference sign 64 added thereto. Further, a detection position DP of the belt zone sensor 61 may be referred to with reference sign P1 added thereto, a detection position DP of the belt zone sensor 62 may be referred to with reference sign P2 added thereto, a detection position DP of the belt zone sensor 63 may be referred to with reference sign P3 added thereto, and a detection position DP of the belt zone sensor 64 may be referred to with reference sign P4 added thereto.

During conveyance of the sheet P, based on a level of an output signal derived from a sheet sensor 6 (here referred to as upstream-side sensor 6) whose detection position is a position DP located upstream of the belt zone 24A in the conveyance direction as well as levels of individual output signals derived from the four belt zone sensors 60, the controller 4 decides whether or not jam has occurred with an in-zone sheet P that is a sheet P having entered the belt zone 24A. Hereinafter, reference sign P0 will be added to the detection position DP of the upstream-side sensor 6.

More specifically, when the front end of the sheet P has arrived at the detection position P0 of the upstream-side sensor 6, the controller 4 starts time count. The sheet P having arrived at the detection position P0 of the upstream-side sensor 6 enters the belt zone 24A (this sheet P becomes an in-zone sheet P).

In this connection, based on time durations required for the sheet P's advances between the detection position P0 of the upstream-side sensor 6 and the detection positions DP of the four belt zone sensors 60, respectively, first jam times are previously set and stored in the storage part 5. A first jam time corresponding to the belt zone sensor 61 is the shortest, another first jam time corresponding to the belt zone sensor 62 is the second shortest, another first jam time corresponding to the belt zone sensor 63 is the third shortest, and another first jam time corresponding to the belt zone sensor 64 is the longest.

Also, plural second jam times corresponding to sizes of plural-type sheets P (conveyance-direction lengths of sheets P) are previously set and stored in the storage part 5. Each of the plural second jam times is set based on a time duration required from the front-end arrival of a sheet P of a corresponding size at one detection position DP until a rear-end passage of the sheet P through the same detection position DP.

In a case where the front end of an in-zone sheet P has not arrived at the detection position P1 even when elapsed time since a start of time count has reached the first jam time corresponding to the belt zone sensor 61, the controller 4 decides that jam has occurred with the in-zone sheet P.

Also, in another case where the front end of the in-zone sheet P has not arrived at the detection position P2 even when elapsed time since the start of time count has reached the first jam time corresponding to the belt zone sensor 62, the controller 4 decides that jam has occurred with the in-zone sheet P.

Also, in still another case where the front end of the in-zone sheet P has not arrived at the detection position P3 even when elapsed time since the start of time count has reached the first jam time corresponding to the belt zone sensor 63, the controller 4 decides that jam has occurred with the in-zone sheet P.

Also, in yet another case where the front end of the in-zone sheet P has not arrived at the detection position P4 even when elapsed time since the start of time count has reached the first jam time corresponding to the belt zone sensor 64, the controller 4 decides that jam has occurred with the in-zone sheet P.

Also, in a case where the front end of the in-zone sheet P has arrived at the detection position DP of any one belt zone sensor 60, given that the rear end of the in-zone sheet P has not passed through the above-mentioned detection position DP even when the second jam time corresponding to the size of the in-zone sheet P has elapsed since the front-end arrival of the in-zone sheet P at the detection position DP, the controller 4 decides that jam has occurred with the in-zone sheet P.

Figure 4:
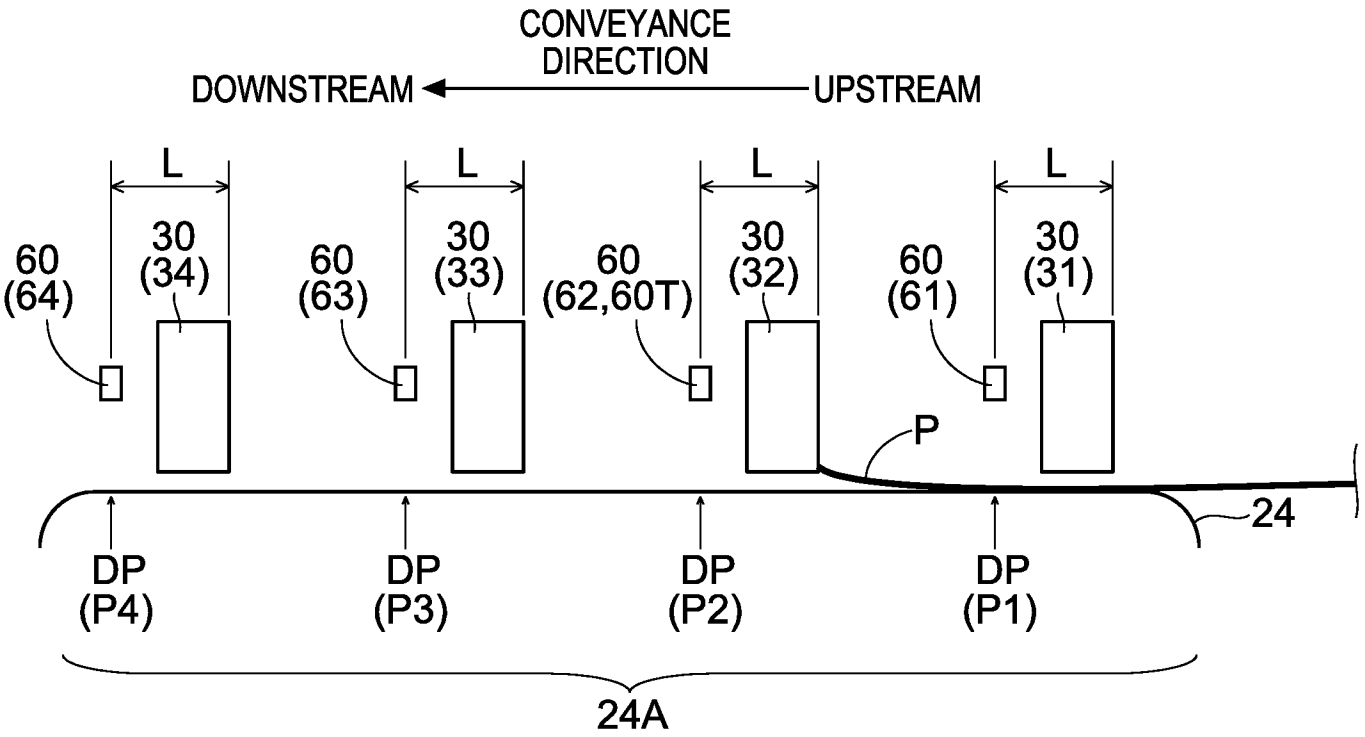
FIG. 4 is a view showing a state in which a front end of a sheet has caught on an ink head of the image forming apparatus according to the embodiment.

As an example, as shown in FIG. 4, in a case where the front end of the in-zone sheet P has caught on the ink head 32, even when elapsed time since a start of time count has reached the first jam time corresponding to the belt zone sensor 62, the front end of the in-zone sheet P does not arrive at the detection position P2. As a result, it is decided that jam has occurred with the in-zone sheet P.

Figure 5:
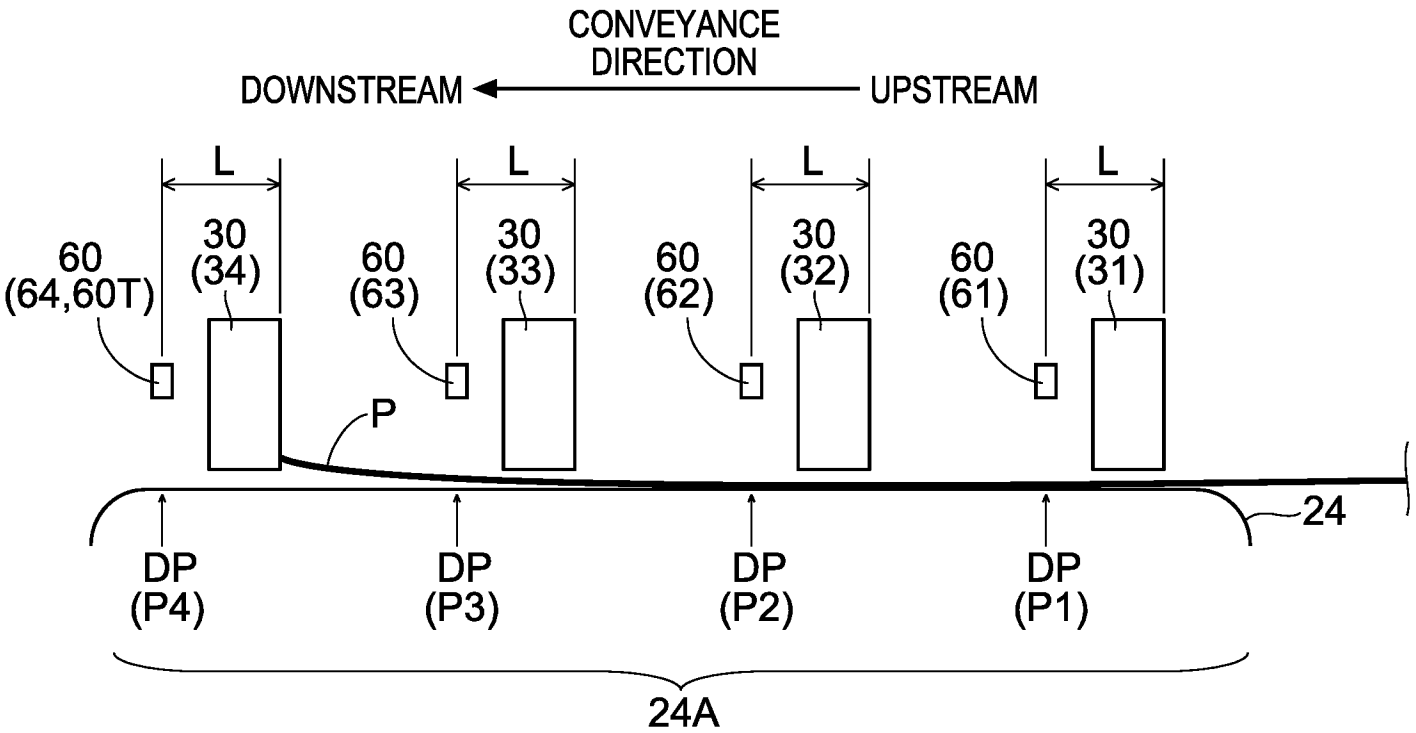
FIG. 5 is a view showing a state in which a front end of a sheet has caught on an ink head of the image forming apparatus according to the embodiment.

As another example, as shown in FIG. 5, in a case where the front end of the in-zone sheet P has caught on the ink head 34, even when elapsed time since a start of time count has reached the first jam time corresponding to the belt zone sensor 64, the front end of the in-zone sheet P does not arrive at the detection position P4. As a result, it is decided that jam has occurred with the in-zone sheet P.

Figure 6:
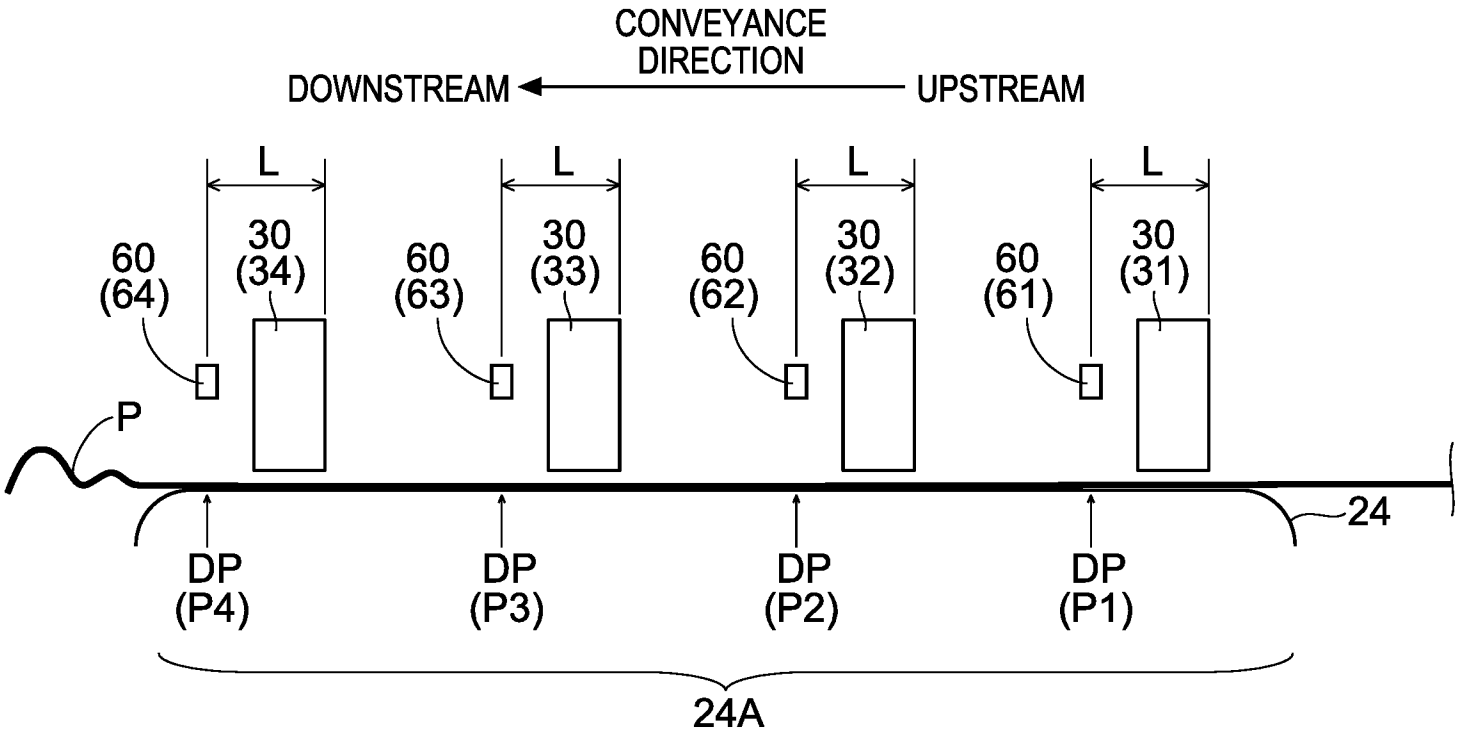
FIG. 6 is a view showing a state in which a front end of a sheet has caught on a member located conveyance-direction downstream of a belt zone in the image forming apparatus according to the embodiment.

As still another example, as shown in FIG. 6, in a case where the front end of the in-zone sheet P has caught at one site (e.g., a portion of a member that guides the conveyance of the sheet P) which is located on the conveyance-direction downstream side of the belt zone 24A, the rear end of the in-zone sheet P passes through none of the detection positions DP of the four belt zone sensors 60. As a result, it is decided that jam has occurred with the in-zone sheet P.

<Notification Process for Urging Cleaning of Conveyor Belt>

For example, assume that the front end of the in-zone sheet P has caught on any one ink head 30. In this case, even with the conveyor belt 24 turning around, the in-zone sheet P does not advance. Accordingly, after the catching of the in-zone sheet P on any one ink head 30, when ink is jetted out from the ink head 30 on which the in-zone sheet P has caught as well as ink heads 30 located on the conveyance-direction downstream side of the above-mentioned ink head 30, ink deposits on the conveyor belt 24 (the conveyor belt 24 is stained).

When the conveyor belt 24 is left as it is stained, ink on the conveyor belt 24 is deposited onto a sheet P that is to be thereafter conveyed by the conveyor belt 24 (the sheet P is stained). Thus, the controller 4 decides whether or not the conveyor belt 24 is stained.

When deciding that the conveyor belt 24 is stained, the controller 4 instructs the operation panel 7 to execute a notification process of urging a user to clean the conveyor belt 24. In the configuration of the disclosure, the operation panel 7 corresponds to a 'notification part.' For example, the operation panel 7 executes, as the notification process, a process of displaying a massage that urges cleaning of the conveyor belt 24. In this process, a cleaning procedure for the conveyor belt 24 may also be displayed.

In addition, a loudspeaker (not shown) may be installed in the image forming apparatus 100, allowing a sound for urging the cleaning of the conveyor belt 24 to be produced from the loudspeaker. With this configuration, the loudspeaker corresponds to a 'notification part.'

Figure 7:
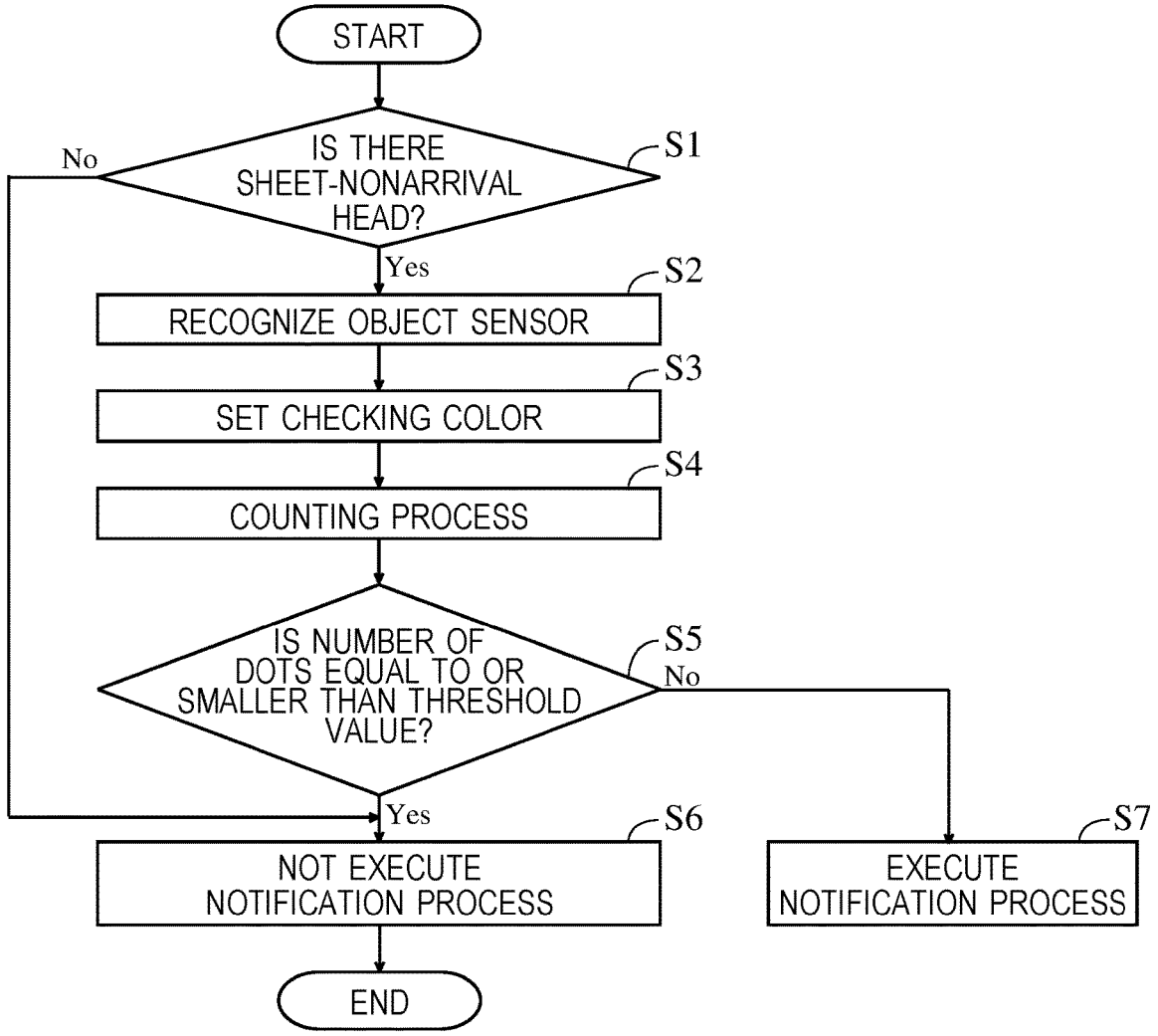
FIG. 7 is a flowchart showing a flow of processing to be executed by a controller of the image forming apparatus according to the embodiment.

Hereinbelow, a flow of processing to be executed by the controller 4 will be described with reference to a flowchart shown in FIG. 7. The processing in the flowchart of FIG. 7 gets started upon a decision by the controller 4 that jam with the in-zone sheet P has occurred in the belt zone 24A.

At step S1, based on levels of individual output signals from the four belt zone sensors 60, respectively, the controller 4 decides, with respect to each one of the four ink heads 30, whether or not an ink head is a sheet-nonarrival head, where the sheet-nonarrival head means that the front end of an in-zone sheet P has not yet arrived at a gap between the ink head 30 and the conveyor belt 24. Then, the controller 4 decides whether or not there is a sheet-nonarrival head. When the controller 4 decides that there is a sheet-nonarrival head, the processing flow moves on to step S2.

For example, assume that such jam as shown in FIG. 4 (i.e., jam with the in-zone sheet P catching on the ink head 32) has occurred. That is, it is assumed that the front end of the in-zone sheet P has arrived at none of gaps between the conveyor belt 24 and the ink heads 32, 33 and 34, respectively.

At a time point when the jam shown in FIG. 4 has occurred, a signal of a first level (i.e., a level indicative that there is an in-zone sheet P) is being outputted from the belt zone sensor 61. Signals of a second level (i.e., a level indicative that there is no in-zone sheet P) are being outputted from the belt zone sensors 62, 63 and 64, respectively.

Further, assume that such jam as shown in FIG. 5 (i.e., jam with the in-zone sheet P catching on the ink head 34) has occurred. That is, it is assumed that the front end of the in-zone sheet P has not arrived at the gap between the ink head 34 and the conveyor belt 24.

At a time point when the jam shown in FIG. 5 has occurred, signals of the first level are being outputted from the belt zone sensors 61, 62 and 63, respectively. A signal of the second level is being outputted from the belt zone sensor 64.

Accordingly, in deciding whether or not there is a sheet-nonarrival head, the controller 4 checks levels of individual output signals from the four belt zone sensors 60. Then, the controller 4 decides that an ink head 30 where a signal of the second level is being outputted from its corresponding belt zone sensor 60 is a sheet-nonarrival head. That is, when a signal of the second level is being outputted from any one belt zone sensor 60, the controller 4 decides that there is a sheet-nonarrival head.

In the case shown in FIG. 4, it is decided that the ink heads 32, 33 and 34 are sheet-nonarrival heads. Also, in the case shown in FIG. 5, it is decided that the ink head 34 is a sheet-nonarrival head.

Upon transition from step S1 to step S2, the controller 4 recognizes, as an object sensor, a belt zone sensor 60 located on the most upstream side in the conveyance direction out of belt zone sensors 60 from which signals of the second level are being outputted (i.e., out of belt zone sensors 60 at corresponding detection positions DP of which the front end of the in-zone sheet P has not arrived). Also at step S3, the controller 4 sets, as a checking color, a color of ink contained in an ink head 30 corresponding to the belt zone sensor 60 recognized as the object sensor.

Hereinafter, a belt zone sensor 60 recognized as an object sensor will have reference sign 60T added thereto and will be referred to as object sensor 60T. In the case shown in FIG. 4, the belt zone sensor 62 is recognized as an object sensor 60T. In the case shown in FIG. 5, the belt zone sensor 64 is recognized as an object sensor 60T.

Thereafter, at step S4, the controller 4 executes a counting process, which will be detailed later. Based on a result of the counting process, the controller 4 decides whether or not to instruct the operation panel 7 to execute the notification process. Depending on a result of the counting process, execution of the notification process may be suppressed even when jam with the in-zone sheet P has occurred in the belt zone 24A.

Figure 8:
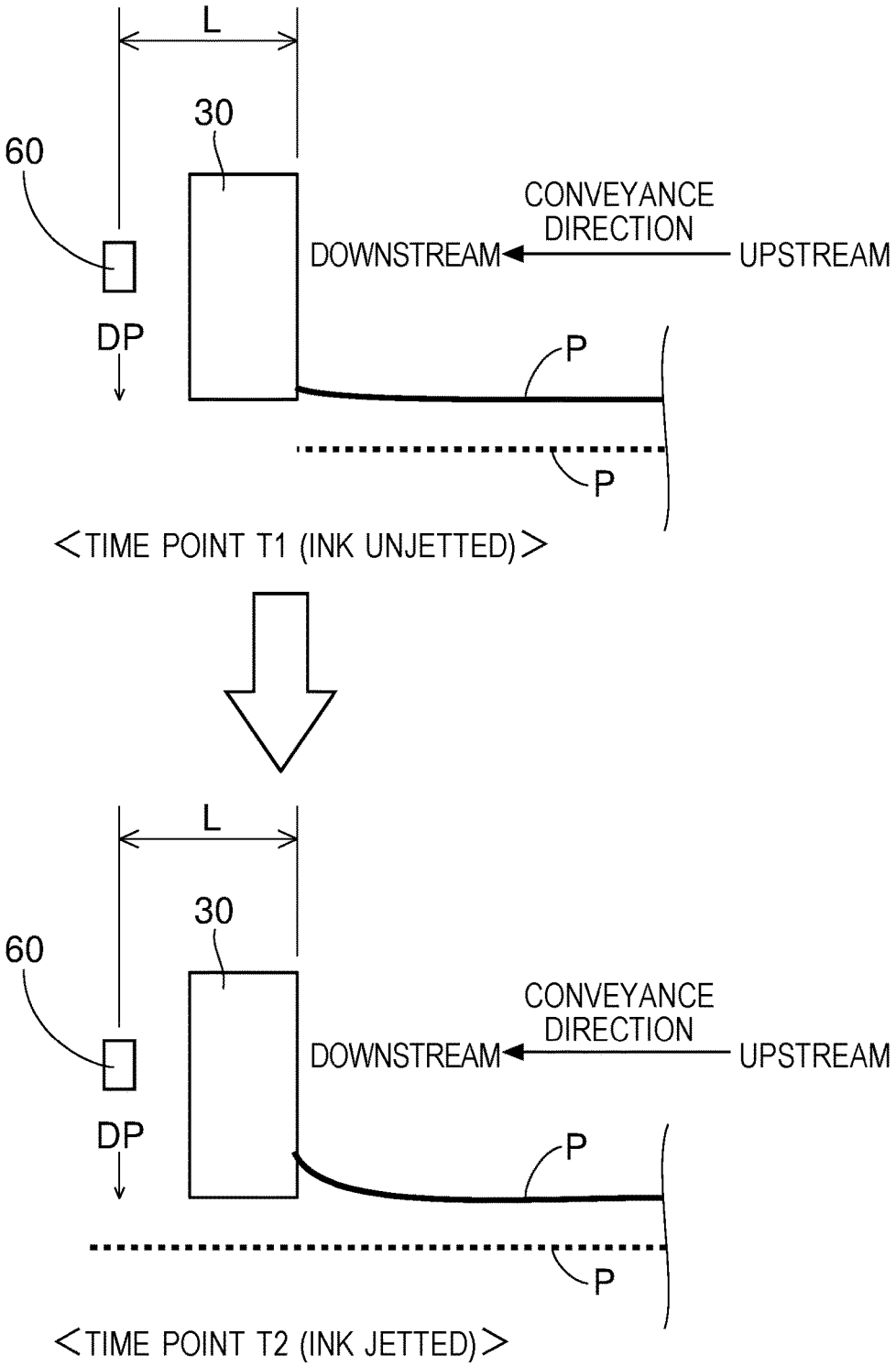
FIG. 8 is a view showing a state in which jam has occurred in the belt zone of the image forming apparatus according to the embodiment.

Now the counting process will be described below. First, a disadvantage resulting in the case where jam with an in-zone sheet P has occurred will be described with reference to FIG. 8. In FIG. 8, a state of an in-zone sheet P that has caught on an ink head 30 is depicted by solid line, while a state of an in-zone sheet P that has not caught on the ink head 30 is depicted by broken line.

At a time point T1 when the in-zone sheet P has caught on the ink head 30 (see upper view of FIG. 8), ink has not been jetted out from the ink head 30 on which the in-zone sheet P has caught. Also at the time point T1, it is not decided that jam has occurred. It is decided at a time point T2 (see lower view of FIG. 8) that jam has occurred, where the time point T2 is after an elapse of time required for the in-zone sheet P to advance by a specified length L since the time point T1. That is, the print job is continued until the time point T2 even with the in-zone sheet P catching on the ink head 30.

Accordingly, in a case where dots of an ink color of an ink head 30 on which the in-zone sheet P has caught are present in an image that is to be printed within an area ranging from a main scanning line of the front end of the in-zone sheet P to another main scanning line distant therefrom by the specified length L, ink is jetted out from the ink head 30 on which the in-zone sheet P has caught even though there is no in-zone sheet P in the gap against the conveyor belt 24. As a result, the conveyor belt 24 is stained (there arises a need for cleaning of the conveyor belt 24). Due to this, the counting process is executed.

For execution of the counting process, the controller 4 recognizes a predetermined checking length. The checking length is stored in the storage part 5. The checking length is a length resulting from adding a specified margin length to the specified length L.

Then, based on image data of an image to be printed on the in-zone sheet P that has jammed in the belt zone 24A, the controller 4 executes, as the counting process, a process of counting a number of dots of the checking color that are present in an image to be printed within an area ranging from a main scanning line of the front end of the in-zone sheet P to another main scanning line distant therefrom by the checking length (=specified length L+specified margin length).

In the case where such jam as shown in FIG. 4 has occurred, the number of dots of an ink color of the ink head 32 corresponding to the belt zone sensor 62 (object sensor 60T) is counted. In the case where such jam as shown in FIG. 5 has occurred, the number of dots of an ink color of the ink head 34 corresponding to the belt zone sensor 64 (object sensor 60T) is counted.

After the processing of step S4, the controller 4, at step S5, decides whether or not a number of dots counted by the counting process is equal to or smaller than a predetermined threshold value. The threshold value is set to zero, as an example. When the controller 4 decides that the number of dots counted by the counting process is equal to or smaller than the threshold value, the processing flow moves on to step S6. On the other hand, when the controller 4 decides that the number of dots counted by the counting process is larger than the threshold value, the processing flow moves on to step S7.

Upon transition to step S6, the controller 4 keeps the operation panel 7 from executing the notification process. On the other hand, upon transition to step S7, the controller 4 allows the operation panel 7 to execute the notification process.

In this connection, in a case where the number of dots counted by the counting process is zero, no ink is jetted out from an ink head 30 corresponding to the object sensor 60T. In this case (Yes at step S5), the notification process does not need to be executed even when jam with an in-zone sheet P has occurred in the belt zone 24A (even when there is a sheet-nonarrival head).

On the other hand, in another case where the number of dots counted by the counting process is other than zero, even though there is no in-zone sheet P at the gap between an ink head 30 corresponding to the object sensor 60T and the conveyor belt 24, ink is jetted out from the above-mentioned ink head 30. That is, ink deposits on the conveyor belt 24. In this case (No at step S5), it is preferable to execute the notification process.

In addition, the threshold value to be used in the counting process may be changed at user's discretion. The operation panel 7 accepts a change in the threshold value. In order to permit more or less stains, the threshold value may be changed to a few dots to tens of dots, as an example.

When the controller 4 decides at step S1 that there is no sheet-nonarrival head, the processing flow moves on to step S6. That there is no sheet-nonarrival head means that such jam as shown in FIG. 6 has occurred. When signals of the first level are being outputted from all the belt zone sensors 60, the controller 4 decides that there is no sheet-nonarrival head.

In the case shown in FIG. 6, an in-zone sheet P is present in the individual gaps between all the ink heads 30 and the conveyor belt 24. Accordingly, no matter from which one of the ink heads 30 ink is jetted out, ink does not deposit on the conveyor belt 24 (ink deposits on the in-zone sheet P). That is, the conveyor belt 24 is not stained. Therefore, in the case where there is no sheet-nonarrival head, the notification process does not need to be executed even when jam with the in-zone sheet P has occurred in the belt zone 24A.

The image forming apparatus 100 of this embodiment, as described above, are provided with the belt zone sensors 60 having detection positions DP within the belt zone 24A. By virtue of this, it can be decided whether or not there is a sheet-nonarrival head. When there is a sheet-nonarrival head, there is a possibility that ink jetted out from an ink head 30 has deposited on the conveyor belt 24. On the other hand, when there is no sheet-nonarrival head, ink does not deposit on the conveyor belt 24 (ink deposits on the in-zone sheet P) even while ink is jetted out from an ink head 30.

Accordingly, when there is no sheet-nonarrival head, the controller 4 keeps the operation panel 7 from executing a notification process of urging cleaning of the conveyor belt 24. As a result, it can be suppressed that the notification process is executed even when no ink has deposited on the conveyor belt 24.

Also in this embodiment, as described above, one belt zone sensor 60 is provided for each one of plural ink heads 30, correspondingly. By virtue of this, when jam with the in-zone sheet P has occurred in the belt zone 24A, it can be decided which one or ones of the ink heads 30 are sheet-nonarrival heads.

Also in this embodiment, as described above, the controller 4 executes the counting process. In the counting process, counted is the number of dots of a checking color (ink color of an ink head 30 corresponding to the object sensor 60T) that are present in an image to be printed within an area ranging from a main scanning line of the front end of the in-zone sheet P to another main scanning line distant therefrom by the checking length (a length resulting from adding a specified margin length to the specified length L). Then, when the number of dots counted by the counting process is equal to or smaller than the threshold value (=0), the controller 4 keeps the operation panel 7 from executing the notification process even with a sheet-nonarrival head present. That is, the notification process is not executed when no ink is jetted out from the sheet-nonarrival head (when the number of dots of the ink color of the sheet-nonarrival head counted by the counting process is equal to or smaller than the threshold value).

Also in this embodiment, when the number of dots counted by the counting process is larger than the threshold value, the controller 4 instructs the operation panel 7 to execute the notification process. By virtue of this, when it is highly likely that the conveyor belt 24 is stained, notification for urging the user to clean the conveyor belt 24 can securely be fulfilled.

<Modification>

As a modification, the setting number of belt zone sensors 60 may be decreased. That is, there is no need for necessarily providing one belt zone sensor 60 for every one of the four ink heads 30. The setting number of belt zone sensors 60 may be three or two. The setting number of belt zone sensors 60 may also be one. However, the belt zone sensor 64 located on the most downstream side in the conveyance direction is indispensable.

Hereinbelow, a configuration of the modification will be described. A basic configuration of the modification is identical to that of the above-described embodiment. Therefore, in the following description, component members in common to the embodiment will be denoted by like designations and like reference signs, with their explanation omitted.

Figure 9:
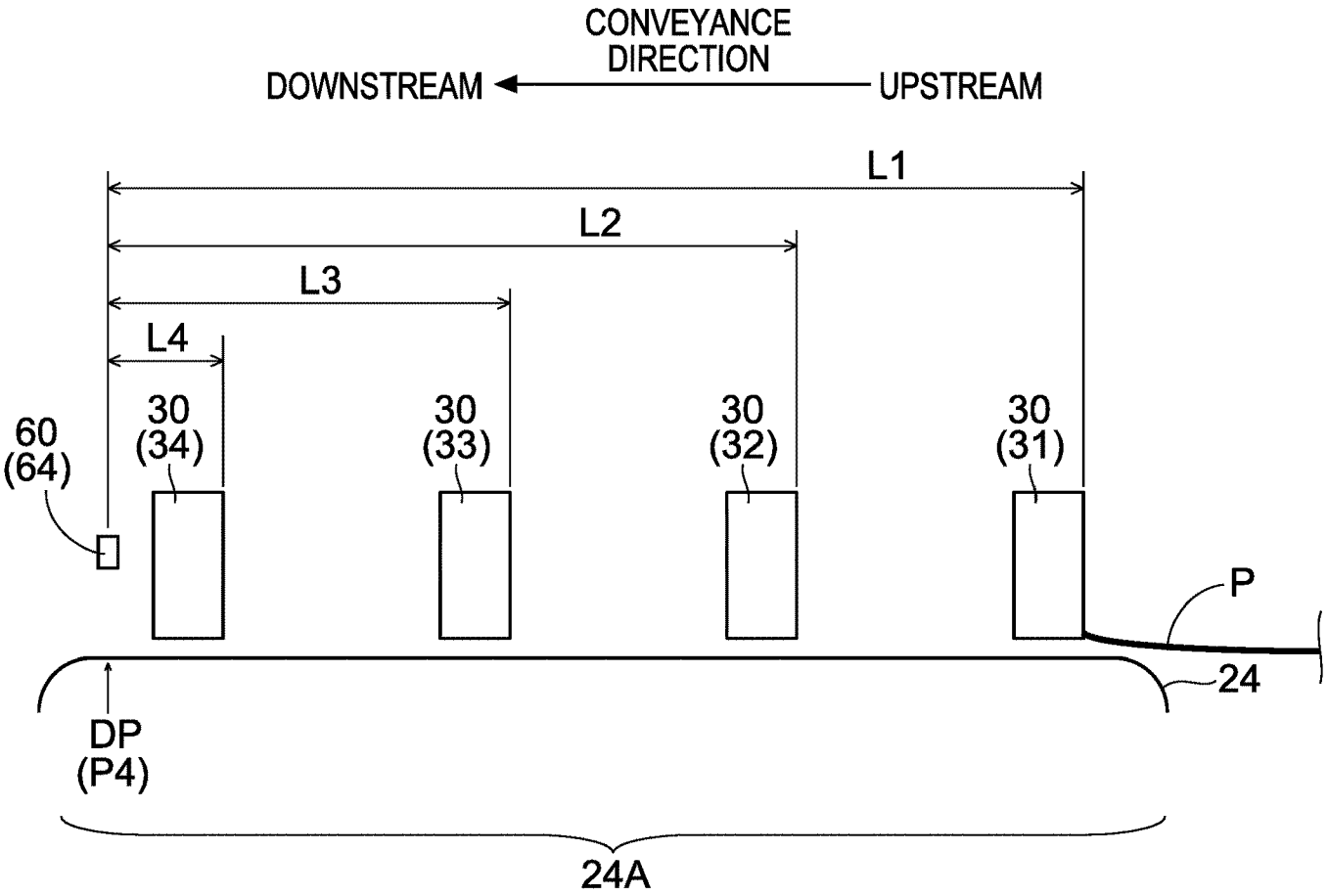
FIG. 9 is a view showing a configuration of a modification of the embodiment.

In the modification, as shown in FIG. 9, the belt zone sensor 64 is employed. The belt zone sensors 61, 62 and 63 are eliminated. The rest of the configuration is the same as in the embodiment.

Figure 10:
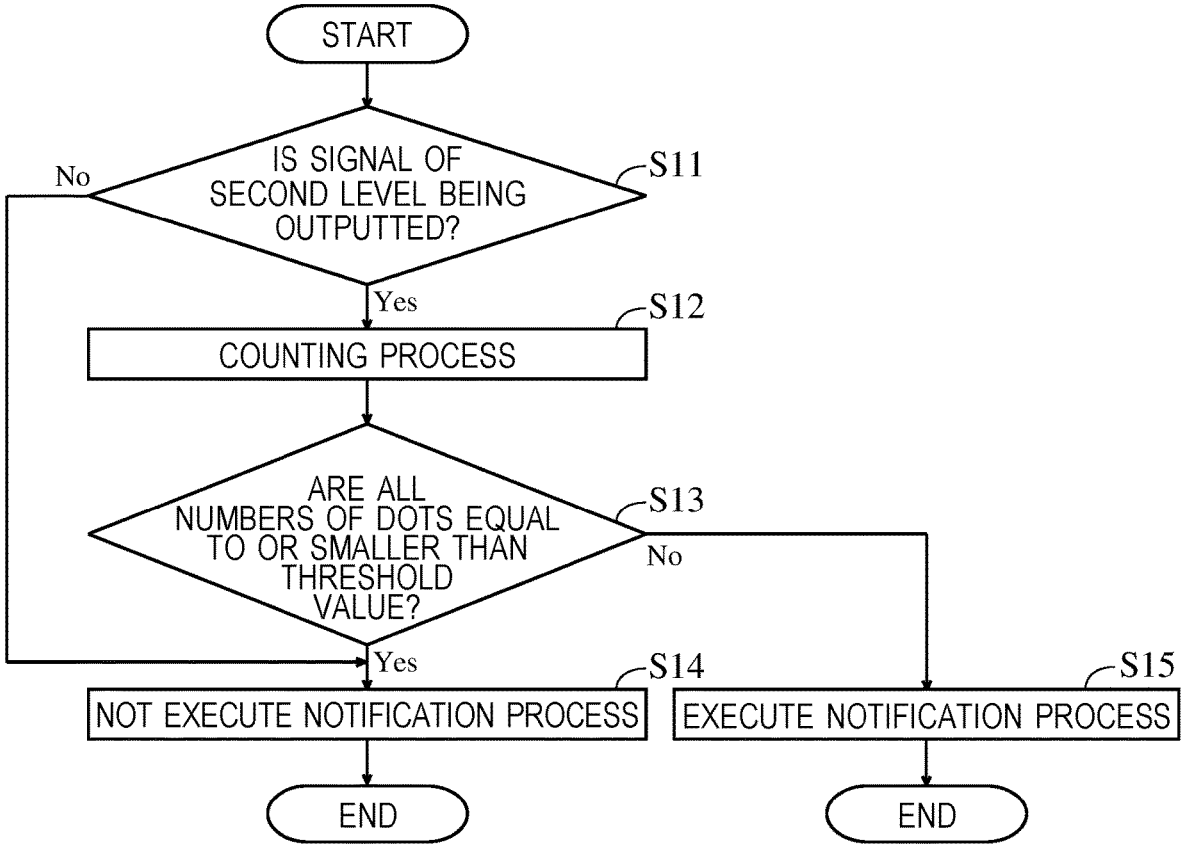
FIG. 10 is a flowchart showing a flow of processing in the modification of the embodiment.

In the modification, processing along a flowchart shown in FIG. 10 is executed by the controller 4. The processing of the flowchart shown in FIG. 10 gets started upon a decision by the controller 4 that jam with the in-zone sheet P has occurred in the belt zone 24A.

At step S11, the controller 4 decides whether or not a signal of the second level is being outputted from the belt zone sensor 64. In other words, the controller 4 decides whether or not there is a sheet-nonarrival head.

With the configuration of the modification, a signal of the second level continues to be outputted from the belt zone sensor 64 in all cases where the front end of the in-zone sheet P has caught on the ink head 31, where the front end of the in-zone sheet P has caught on the ink head 32, where the front end of the in-zone sheet P has caught on the ink head 33, and where the front end of the in-zone sheet P has caught on the ink head 34. When the front end of the in-zone sheet P has caught at one site located on the conveyance-direction downstream side of the belt zone 24A (when the front end of the in-zone sheet P has caught on none of the ink heads 30), a signal of the first level continues to be outputted from the belt zone sensor 64.

That is, that a signal of the second level is being outputted from the belt zone sensor 64 means that there is a sheet-nonarrival head. However, it is impossible to discriminate which one of the ink heads 30 is the sheet-nonarrival head. On the other hand, that a signal of the first level is being outputted from the belt zone sensor 64 means that there is no sheet-nonarrival head.

When the controller 4 decides that there is a sheet-nonarrival head, the processing flow moves on to step S12. Upon transition to step S12, the controller 4 executes the counting process.

With the configuration of the modification, assume that the front end of the in-zone sheet P has caught on the ink head 31 as shown in FIG. 9. In this case, it is decided that jam occurred after an elapse of time required for the in-zone sheet P to advance by a length L1 since the catching of the in-zone sheet P on the ink head 31. Accordingly, in a case where dots of an ink color of the ink head 31 are present in an image that is to be printed within an area ranging from a main scanning line of the front end of the in-zone sheet P to another main scanning line distant therefrom by the length L1, ink is jetted out from the ink head 31, even though there is no in-zone sheet P in the gap between the ink head 31 and the conveyor belt 24. As a result, ink deposits on the conveyor belt 24, necessitating the cleaning of the conveyor belt 24.

Also, in another case where dots of an ink color of the ink head 32 are present in an image that is to be printed within an area ranging from the main scanning line of the front end of the in-zone sheet P to another main scanning line distant therefrom by a length L2, ink is jetted out from the ink head 32, even though there is no in-zone sheet P in the gap between the ink head 32 and the conveyor belt 24. In still another case where dots of an ink color of the ink head 33 are present in an image that is to be printed within an area ranging from the main scanning line of the front end of the in-zone sheet P to another main scanning line distant therefrom by a length L3, ink is jetted out from the ink head 33, even though there is no in-zone sheet P in the gap between the ink head 33 and the conveyor belt 24. In yet another case where dots of an ink color of the ink head 34 are present in an image that is to be printed within an area ranging from the main scanning line of the front end of the in-zone sheet P to another main scanning line distant therefrom by a length L4, ink is jetted out from the ink head 34, even though there is no in-zone sheet P in the gap between the ink head 34 and the conveyor belt 24.

In addition, the length L1 is a conveyance-direction length from a conveyance-direction upstream-side end position of the ink head 31 to the detection position P4. The length L2 is a conveyance-direction length from a conveyance-direction upstream-side end position of the ink head 32 to the detection position P4. The length L3 is a conveyance-direction length from a conveyance-direction upstream-side end position of the ink head 33 to the detection position P4. The length L4 is a conveyance-direction length from a conveyance-direction upstream-side end position of the ink head 34 to the detection position P4.

In the modification, such a counting process as shown below is executed.

In executing the counting process, the controller 4 sets, as a checking color, an ink color of any one of the ink heads 30. Then, the controller 4 executes the counting process with the set checking color taken as an object. The counting process is carried out for each ink color of all the ink heads 30. That is, the counting process is carried out for four colors. After executing the counting process with one ink color set as the checking color, the controller 4 executes the counting process once again with another ink color (ink color that has not yet set as an object of the counting process) set as a new checking color.

Upon setting a checking color, the controller 4 recognizes a checking length corresponding to the checking color. It is noted here that the checking length is predetermined for each ink color and stored in the storage part 5. The checking length is a length resulting from adding a specified margin length to a conveyance-direction length from an upstream-side end position of an ink head 30, in which ink of a corresponding color is contained, to the detection position P4 of the belt zone sensor 64.

That is, the checking length corresponding to the ink color of the ink head 31 is a length resulting from adding a specified margin length to the length L1. The checking length corresponding to an ink color of the ink head 32 is a length resulting from adding a specified margin length to the length L2. The checking length corresponding to an ink color of the ink head 33 is a length resulting from adding a specified margin length to the length L3. The checking length corresponding to an ink color of the ink head 34 is a length resulting from adding a specified margin length to the length L4.

Figure 11:
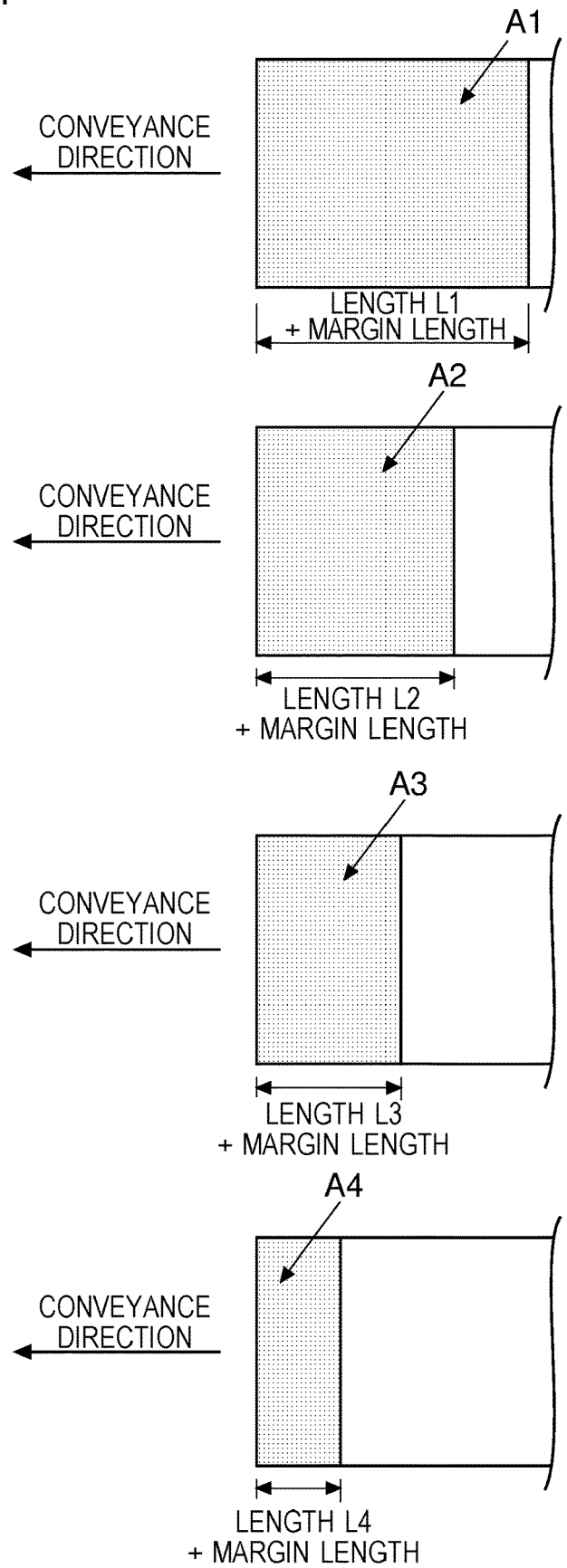
FIG. 11 is a view for explaining a counting process in the modification of the embodiment.

Thereafter, the controller 4 executes, as the counting process for each color, a process of, based on image data of an image to be printed on the in-zone sheet P that has jammed in the belt zone 24A, counting the number of dots of the checking color present in an image that is to be printed within an area (here referred to as checking area) ranging from a main scanning line of the front end of the in-zone sheet P to another main scanning line distant therefrom by the checking length corresponding to the checking color. The size of the checking area varies depending on the ink color that is taken as the object of the counting process. Differences in size of the checking area of each ink color are shown in FIG. 11. In FIG. 11, the checking area is depicted by dot patterns. Also in FIG. 11, a checking area corresponding to the ink color of the ink head 31 is denoted by reference sign A1, a checking area corresponding to the ink color of the ink head 32 is denoted by reference sign A2, a checking area corresponding to the ink color of the ink head 33 is denoted by reference sign A3, and a checking area corresponding to the ink color of the ink head 34 is denoted by reference sign A4.

Each time the counting process is ended, the controller 4 decides whether or not any ink color remains as it has not yet been set as the checking color. When there remains an unset ink color, the controller 4 sets the unset ink color as a new checking color, and repeats the counting process. When the counting process for the four colors is all ended, the processing flow moves on from step S12 to step S13.

At step S13, the controller 4 decides whether or not all the numbers of dots counted by the counting process for the individual colors are equal to or smaller than a predetermined threshold value. The threshold value is zero as an example. When the controller 4 decides that all the numbers of dots counted by the counting process for the individual colors are equal to or smaller than the threshold value, the processing flow moves on to step S14. On the other hand, when the controller 4 decides that any one of the numbers of dots counted by the counting process for the individual colors is larger than the threshold value, the processing flow moves on to step S15.

Upon transition to step S14, the controller 4 keeps the operation panel 7 from executing the notification process. It is noted here that all the numbers of dots counted by the counting process for the individual colors are equal to or smaller than the threshold value means that ink is jetted out from none of the ink heads 30. Thus, there is no need for executing the notification process even though there is a sheet-nonarrival head.

Upon transition to step S15, the controller 4 instructs the operation panel 7 to execute the notification process. It is noted here that any one of the numbers of dots counted by the counting process for the individual colors is larger than the threshold value means that ink is jetted out from an ink head 30 corresponding to the ink color of which the number of counted dots is larger than the threshold value.

For example, in a case where such jam as shown in FIG. 9 has occurred, assume that the number of dots of the ink color of the ink head 31 is larger than the threshold value. That is, assume that ink is jetted out from the ink head 31. In this case, since there is no in-zone sheet P in the gap between the ink head 31 and the conveyor belt 24, ink jetted out from the ink head 31 deposits on the conveyor belt 24. Thus, the cleaning of the conveyor belt 24 is necessitated.

In addition, although not shown, assume that in a case where there has occurred jam with the front end of the in-zone sheet P catching on the ink head 32, the number of dots of the ink color of the ink head 31 is larger than the threshold value. In this case, the in-zone sheet P is present in the gap between the ink head 31 and the conveyor belt 24. Even with ink jetted out from the ink head 31, ink does not deposit on the conveyor belt 24 (ink deposits on the in-zone sheet P).

However, with the configuration of the modification, the controller 4, although making a decision as to whether or not there is a sheet-nonarrival head, yet does not further decide which one of the ink heads 30 is a sheet-nonarrival head. Accordingly, in the case where ink is jetted out from any one of the ink heads 30, it is preferable to execute the notification process on an assumption that such jam as shown in FIG. 9 has occurred.

Also, when the controller 4 decides at step S11 that there is no sheet-nonarrival head, the processing flow moves on to step S14. That there is no sheet-nonarrival head means that the in-zone sheet P is present in every gap between all the ink heads 30 and the conveyor belt 24. Accordingly, even when ink is jetted out from any ink head 30, ink does not deposit on the conveyor belt 24 (ink deposits on the in-zone sheet P). That is, the conveyor belt 24 is not stained. Therefore, in the case where there is no sheet-nonarrival head, there is no need for executing the notification process even though jam with the in-zone sheet P has occurred in the belt zone 24A.

With the configuration of the modification, as described above, the setting number of the belt zone sensor 60 is one. The one belt zone sensor 60 is set on the conveyance-direction downstream side of the ink head 30 that is located on the most downstream side in the conveyance direction. As a result, even when the setting number of the belt zone sensor 60 is one, it is implementable to decide whether or not there is a sheet-nonarrival head.

Also with the configuration of the modification, as described above, the controller 4 executes the counting process for each one of all the ink colors. In the counting process of the modification, the checking length varies depending on the color. By virtue of this, it can accurately be decided whether or not ink has been jetted out for each of the individual ink colors.

The embodiment disclosed herein should be construed as not being limitative but being an exemplification at all points. The scope of the disclosure is defined not by the above description of the embodiment but by the appended claims, including all changes and modifications equivalent in sense and range to the claims.

What is claimed is:

1. An image forming apparatus comprising:

a conveyor belt for conveying a sheet in a belt zone;

a plurality of ink heads which are placed opposite the conveyor belt with a distance thereto and arrayed with intervals provided to one another in a conveyance direction of the sheet, and which jet out ink toward the conveyor belt being under conveyance of the sheet to fulfill printing on the sheet;

a sensor whose detection position is a position within the belt zone and which outputs a signal corresponding to presence or absence of the sheet at the detection position;

a controller for, upon occurrence of jam with the sheet, halting the printing; and a notification part for executing a notification process that urges cleaning of the conveyor belt, wherein in a case where the jam has occurred with an in-zone sheet that is the sheet having entered the belt zone, the controller, based on an output signal of the sensor, decides for each one of the plurality of ink heads whether or not an ink head is a sheet-nonarrival head where a conveyance-direction front end of the in-zone sheet has not yet arrived at a gap between the ink head and the conveyor belt, and given that the sheet-nonarrival head is absent, the controller keeps the notification part from executing the notification process.

2. The image forming apparatus according to claim 1, wherein a setting number of the sensor is equal to a setting number of the ink heads;

the sensors are assigned to the plurality of ink heads respectively in one-to-one correspondence;

the plural sensors are placed on a conveyance-direction downstream side of their corresponding ink heads, respectively; and in a case where the jam with the in-zone sheet has occurred, given that signals of a first level indicating presence of the in-zone sheet are being outputted from all the sensors, respectively, the controller decides that the sheet-nonarrival head is absent.

3. The image forming apparatus according to claim 2, wherein each of the plural sensors has the detection position which is a position distant by a specified length from a conveyance-direction upstream-side end position of the corresponding ink head, a length resulting from adding a specified margin length to the specified length is predetermined as a checking length, the inks of mutually different colors are contained in the plurality of ink heads, respectively, upon occurrence of the jam with the in-zone sheet, given that a signal of a second level indicating absence of the in-zone sheet is being outputted from any one of the sensors, the controller decides that the sheet-nonarrival head is present, in a case where the sheet-nonarrival head is present, the controller recognizes, as an object sensor, one of the sensors located on a most upstream side in the conveyance direction out of the sensors from which the signal of the second level is being outputted, and then the controller sets, as a checking color, the color of the ink contained in the ink head corresponding to the object sensor, and thereafter executes a counting process of counting a number of dots of the checking color present in an image that is to be printed within an area ranging from a main scanning line of the conveyance-direction front end of the in-zone sheet to another main scanning line distant therefrom by the checking length, and given that the number of dots counted by the counting process is equal to or smaller than a predetermined threshold value, the controller keeps the notification part from executing the notification process, even though the sheet-nonarrival head is present.

4. The image forming apparatus according to claim 3, wherein given that the number of dots counted by the counting process is larger than the threshold value, the controller instructs the notification part to execute the notification process.

5. The image forming apparatus according to claim 1, wherein a setting number of the sensor is one;

the sensor is placed on a conveyance-direction downstream side of the ink head that is located on a most downstream side in the conveyance direction, and in a case where the jam with the in-zone sheet has occurred, given that signals of a first level indicating presence of the in-zone sheet is being outputted from the sensor, the controller decides that the sheet-nonarrival head is absent.

6. The image forming apparatus according to claim 5, wherein the inks of mutually different colors are contained in the plurality of ink heads, respectively, a checking length is predetermined for each of the colors, the checking length is a length resulting from adding a specified margin length to a conveyance-direction length ranging from a conveyance-direction upstream-side end position of the ink head with the ink of its corresponding color contained therein to the detection position of the sensor, in a case where the jam with the in-zone sheet has occurred, given that a signal of a second level indicating absence of the in-zone sheet is being outputted from the sensor, the controller decides that the sheet-nonarrival head is present, in a case where the sheet-nonarrival head is present, the controller sets any one of the colors as a checking color, and thereafter executes a counting process of counting a number of dots of the checking color present in an image that is to be printed within an area ranging from a main scanning line of the conveyance-direction front end of the in-zone sheet to another main scanning line distant therefrom by the checking length corresponding to the checking color, and the controller executes the counting process for each of all the colors, and given that all the numbers of dots counted by the counting process are equal to or smaller than a predetermined threshold value, the controller keeps the notification part from executing the notification process, even though the sheet-nonarrival head is present.

7. The image forming apparatus according to claim 6, wherein given that any one of the numbers of dots counted by the counting process is larger than the threshold value, the controller instructs the notification part to execute the notification process.

* * * * *